US008939048B2

(12) United States Patent
Holen

(10) Patent No.: US 8,939,048 B2
(45) Date of Patent: Jan. 27, 2015

(54) DEVICE AND METHOD FOR ROTATION OF TORQUE TONG

(75) Inventor: Bernt Olav Holen, Mandal (NO)

(73) Assignee: Aker MH AS, Kristiansand (NO)

( * ) Notice: Subject to any disclaimer, the term of this patent is extended or adjusted under 35 U.S.C. 154(b) by 468 days.

(21) Appl. No.: 13/382,331

(22) PCT Filed: Jun. 16, 2010

(86) PCT No.: PCT/NO2010/000232

§ 371 (c)(1),
(2), (4) Date: Jan. 25, 2012

(87) PCT Pub. No.: WO2011/005102

PCT Pub. Date: Jan. 13, 2011

(65) Prior Publication Data

US 2012/0111155 A1 May 10, 2012

(30) Foreign Application Priority Data

Jul. 6, 2009 (NO) ..... 20092557

(51) Int. Cl.

| | |
|---|---|
| ***B25B 17/00*** | (2006.01) |
| ***B25B 29/00*** | (2006.01) |
| ***E21B 19/16*** | (2006.01) |

(52) U.S. Cl.

CPC ..... *E21B 19/163* (2013.01); *E21B 19/168* (2013.01); *E21B 19/161* (2013.01); *E21B 19/16* (2013.01)

USPC ..... 81/57.19; 81/57.22; 81/57.44; 81/65.2; 81/64; 81/57.33; 81/57.35

(58) Field of Classification Search

CPC ..... B25B 13/52; E21B 19/161; E21B 19/163; E21B 19/164; E21B 19/16; E21B 19/168

USPC ..... 81/57.19, 57.22, 57.44, 65.2

See application file for complete search history.

(56) References Cited

U.S. PATENT DOCUMENTS

| | | | | |
|---|---|---|---|---|
| 1,760,167 A * | 5/1930 | Palmer | ..... | 81/57.17 |
| 2,650,070 A * | 8/1953 | Lundeen | ..... | 81/57.18 |
| 2,989,880 A | 7/1958 | Hesser et al. | | |

(Continued)

FOREIGN PATENT DOCUMENTS

| | | |
|---|---|---|
| WO | WO 2004/076805 A1 | 9/2004 |
| WO | WO 2004/076806 A1 | 9/2004 |

*Primary Examiner* — Bryan R Muller

(74) *Attorney, Agent, or Firm* — Birch, Stewart, Kolasch & Birch, LLP

(57) ABSTRACT

A device for rotation of a torque tong with at least two diametrically opposite circular arc-shaped segments and gripping devices for holding a pipe substantially perpendicularly to the torque tong's radial plane. To each segment and in abutment thereto there is provided at least one elongated flexible drive element operatively connected to support units and devices for movement of the respective drive element so that the torque tong is rotated in the radial plane. Each drive element is attached at first and second ends to respective securing portions and includes an engagement portion in engagement with and/or abutment against a segment. Rotation of the torque tong is implemented by performing a rectilinear movement of a first of said movement elements, and simultaneously implementing a rectilinear movement of the second of said movement elements in the opposite direction to and substantially parallel to the movement of the first movement element.

18 Claims, 7 Drawing Sheets

(56) References Cited

U.S. PATENT DOCUMENTS

| | | | | | |
|---|---|---|---|---|---|
| 2,862,690 | A | * | 12/1958 | Mason | 81/57.17 |
| 2,879,680 | A | * | 3/1959 | Beeman et al. | 81/57.18 |
| 2,923,192 | A | * | 2/1960 | Montgomery et al. | 81/57.44 |
| 2,992,577 | A | * | 7/1961 | Marxen | 81/57.22 |
| 3,691,875 | A | * | 9/1972 | Geczy et al. | 81/57.14 |
| 4,212,212 | A | * | 7/1980 | Chandler et al. | 81/57.17 |
| 4,324,157 | A | * | 4/1982 | Soutsos | 81/57.17 |
| 4,334,444 | A | | 6/1982 | Carstensen et al. | |
| 4,474,088 | A | | 10/1984 | Lee | |
| 4,604,922 | A | * | 8/1986 | Soutsos | 81/57.17 |
| 6,829,967 | B1 | * | 12/2004 | Kemp | 81/57.15 |

* cited by examiner

DEVICE AND METHOD FOR ROTATION OF TORQUE TONG

The invention relates to a device for rotation of a torque tong as indicated in the preamble to the appended claim 1 and a method for the same.

BACKGROUND OF THE INVENTION

When assembling or disassembling pipe strings which are lowered into or down to a well in the subsurface, for example for production of petroleum, so-called power tongs or torque tongs are normally used for connecting or disconnecting pipe lengths to or from the pipe string. A common configuration is where an upper pipe part is manoeuvred and held by a gripping device, while a pipe part located below is rotated by means of a rotatable torque tong. Another configuration is where the pipe string is held by a first power tong and/or slips in the drill floor, while a rotatable torque tong rotates a pipe element above with the necessary torque. The rotatable torque tong is provided with gripping jaws in order to hold the pipe in the centre of the torque tong, so that when the torque tong rotates, the pipe element will also rotate about its longitudinal axis. In other words, the torque tong's axis of rotation and the pipe element's longitudinal axis are substantially coincident.

Developments in the field of well drilling, such as in connection with directional drilling, have created the need for higher torque and larger angles of rotation, e.g. 60°-90°. More powerful drilling machines (e.g. so-called top drives) which subject the pipes to greater torques than before, result in a need for rotary tongs which can handle correspondingly higher torques during connection ("make-up") and disconnection ("break-out").

Many of the known torque tongs are capable of performing a rotation of between 30°-45°. If it is necessary to rotate the pipe further when using these torque tongs, the pipe has to be released from the gripping jaws, the torque tong rotated back to the initial position and the rotation repeated. This operation may have to be repeated two or three times, which is time-consuming and increases the risk of errors and damage.

The known torque tongs have hydraulic cylinders which rotate the tong directly. This produces different forces, depending on whether the cylinder pushes or pulls, and this can make it difficult to achieve an accurate control of the torque and may give an unbalanced power picture. With rotation over large angles it is difficult to control geometry and thereby the torque. The torque is usually calculated by measuring the hydraulic pressure in the cylinders, together with the cylinders' stroke length (which is measured by means of sensors). With torque tongs of this type it is also necessary to have sensors in order to demonstrate the cylinders' end stroke, in order to prevent the end stroke from being confused with torque build-up. Known solutions require a radial support. This gives increased friction, resulting in a loss of torque for the tong which is difficult to demonstrate or measure its extent. In some cases the friction may also vary with the torque.

There is a need for a tong which can rotate over larger angles than hitherto known, thereby making it possible to screw the pipes together with sufficient torque in one operation, without having to take a new grip. There is furthermore a need for a rotatable tong which provides a constant force, without the need for sensors or the like in order to calculate torques or forces as is the case in the prior art.

SUMMARY OF THE INVENTION

The object of the invention is to remedy or reduce at least one of the disadvantages of the prior art.

The object is achieved according to the invention by the features indicated in the description below and in the following patent claims.

With the present invention a device is provided for rotation of a torque tong with at least one circular arc-shaped segment and gripping devices for holding a pipe substantially perpendicularly to the torque tong's radial plane, characterised in that to the at least one segment and in abutment thereto there is provided at least one elongated flexible drive element which is operatively connected to support units and devices for movement of the at least one drive element, with the result that the torque tong is rotated in the radial plane.

In an embodiment of the present invention a device is provided for rotation of a torque tong with at least two diametrically opposite circular arc-shaped segments and gripping devices for holding a pipe substantially perpendicularly to the torque tong's radial plane, characterised in that to each segment and in abutment thereto there is provided at least one elongated flexible drive element which is operatively connected to support units and devices for movement of the respective drive element, with the result that the torque tong is rotated in the radial plane.

The individual drive element is preferably attached at its first and second ends to respective securing portions and further comprises an engagement portion which is in engagement with and/or abutment against a segment.

In a preferred embodiment the support units for the individual drive element comprise a pair of first support units rotatably mounted in the area at each end of the respective engagement portion.

The devices for movement of the individual drive element preferably comprise a pair of second support units rotatably mounted on a respective movement element arranged for rectilinear movement in the torque tong's radial plane, and where a portion of the drive element which is located between one of the first support units and a respective securing portion is mounted on the respective second support unit.

In an embodiment the movement element comprises a cylinder housing which is slidably mounted on a stem which is attached at its first and second ends to respective fastenings and where a cylinder piston of a known type with oppositely directed piston areas is provided on the stem in the housing's internal chamber, with the result that the cylinder housing is movable along the stem when a hydraulic fluid is supplied to the chamber on one side or the other of the piston.

In an embodiment the torque tong comprises a substantially circular body in the said radial plane, and an opening for insertion of a pipe which is to be gripped by the gripping devices.

In an embodiment a first set of drive elements is assigned to a first segment and a second set of drive elements is assigned to a second segment, where the drive elements in each set are placed one above the other and are movable in the torque tong's radial plane.

In an embodiment the individual drive element is secured to its respective segment at an attachment point on the torque tong, where the attachment point is located substantially halfway between the ends of the segment when the torque tong is in a central position.

The drive element may comprise a lifting chain which is fixed to the tong at an attachment point. The torque tong is preferably supported in the axial direction by a plate, preferably via friction-reducing means.

The support units are preferably rotatably attached to the plate, the securing portions for the individual drive element are attached to the plate and the fastenings for the cylinder stem are attached to the plate.

A method is also provided for rotation of the torque tong according to the invention, characterised by causing a rectilinear movement of a first of said movement elements, while simultaneously causing a rectilinear movement of the second of said movement elements in the opposite direction to and substantially parallel to the movement of the first movement element.

With the torque tong according to the invention it is possible to obtain angles of rotation of between 60°-90° in one rotation, in addition to the ability to handle larger torques than hitherto known.

On account of the torque tong's geometry and relative positioning of support units and movement devices, a predictable and balanced power picture is achieved, without the need for sensors or the like for monitoring and/or measurement of torques or forces acting on the tong during rotation. The manner in which the chains are affixed to the abutment surfaces on the torque tong's circular arc-shaped segments causes the tong to be guided towards, and rotatably secured in its centre.

The chains act as a frictionless and symmetrical radial support, ensuring a balanced power picture. A further radial support (with associated loss of torque) is not necessary.

BRIEF DESCRIPTION OF THE DRAWINGS

An embodiment of the invention will now be described with reference to the appended figures where identical parts have been given identical reference numerals, and where.

DESCRIPTION OF AN EMBODIMENT OF THE INVENTION

Figure 1:
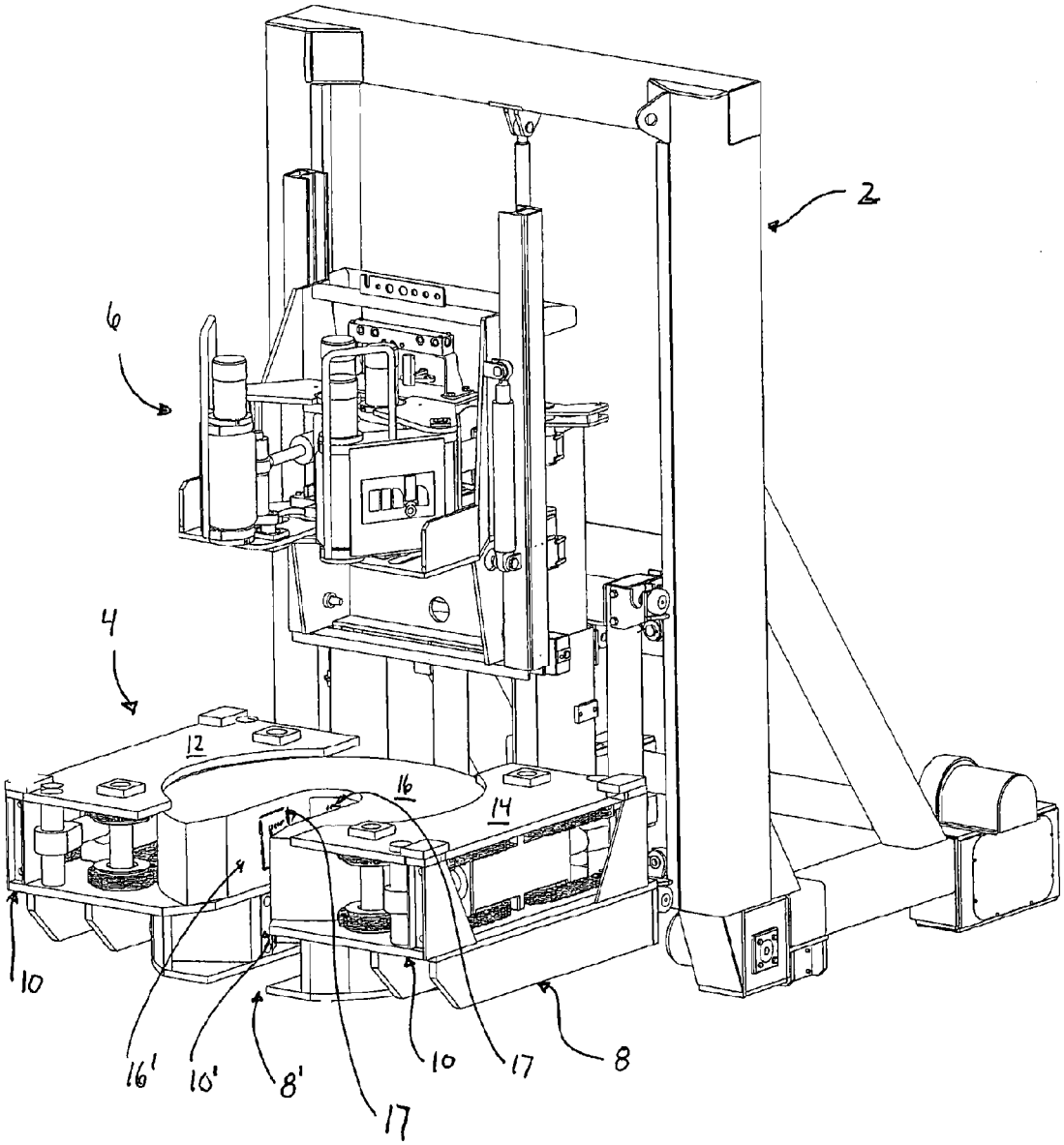
FIG. 1 is a perspective view of an embodiment of the torque tong according to the invention, mounted on a support frame.

FIG. 1 illustrates the torque tong 16 mounted in a tool unit 4 which is supported by a structure 8 attached to a frame 2. To the frame 2 a gripping unit 6 is also attached for manoeuvring and holding a pipe element while the torque tong performs its rotational movement in order to screw on or unscrew a second pipe element.

In the illustrated embodiment the tool unit 4 comprises covers 12, 14 and a plate 10 resting on the support structure 8. Both the support structure 8, the plate 10 and the torque tong 16 are provided with suitable openings 8', 10', 16' for insertion of a pipe to the centre of the torque tong where it is gripped and held by gripping devices of a known type, for example movable jaws 17 or the like. The pipe, which a person skilled in the art will understand is inserted approximately vertically in the device in FIG. 1, is not illustrated in the figures since this is well known. However, it will be understood from FIG. 1 that when a pipe is in place in the torque tong 16 and held in the gripping devices 17, the pipe's longitudinal axis will substantially be coincident with the torque tong's axis of rotation, i.e. substantially perpendicular to the torque tong's rotational plane.

Figure 2:
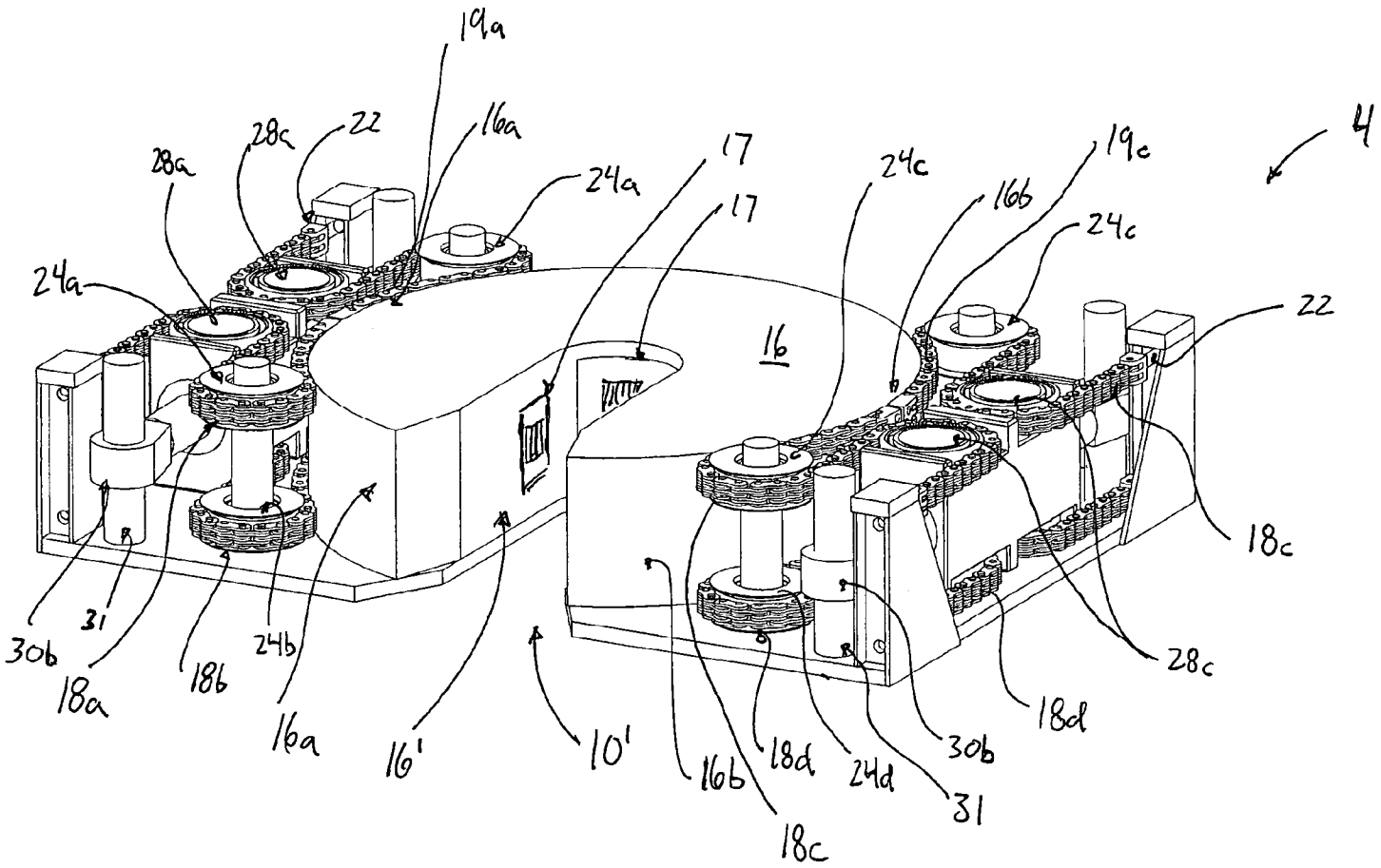
FIG. 2 is a perspective view of the torque tong illustrated in FIG. 1, where top covers are removed and the torque tong is in a neutral, or central, position.
Figure 3:
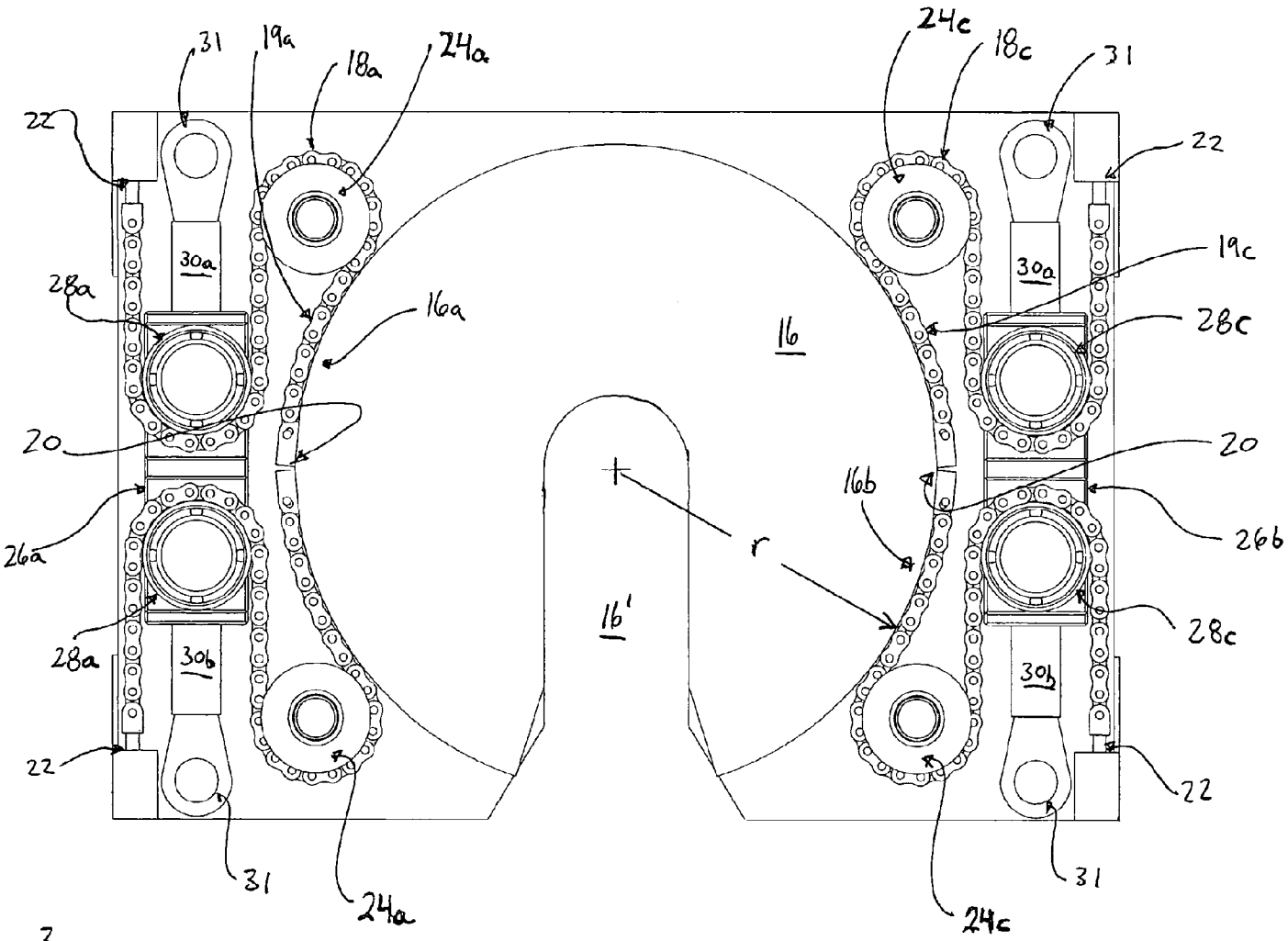
FIG. 3 shows the torque tong as illustrated in FIG. 2, viewed from above.

The tool unit 4 is illustrated in greater detail in FIG. 2. Here the covers 12, 14 are removed in order to better illustrate the rotary devices. With reference also to FIG. 3, in the illustrated embodiment the torque tong 16 comprises a circular body with a central opening 16' and movable gripping jaws 17 (shown in a retracted state). The torque tong 16 is preferably supported on the plate 10, preferably via intermediate friction-reducing elements or means of known per se type (not shown). Some examples are rollers, balls or sliding cushions which ensure a low-friction axial support.

In an embodiment the torque tong comprises a pair of diametrically opposite circular arc-shaped segments 16*a,b* against each of which one or more chains 18*a-d* are secured. The part of each chain 18*a-d* which at any time is in abutment and/or engagement with a corresponding segment 16*a,b* of the torque tong will hereinafter be referred to as the chain's engagement portion. Such engagement portions are indicated by reference numerals 19*a-d* in the figures.

In the illustrated embodiment two chains are arranged against each segment. FIGS. 2 and 3 illustrate a first set of chains 18*a, b* which are assigned to a first segment 16*a*, and a second set of chains 18*c,d* which are assigned to a second segment 16*b*. One chain in each set is placed above the second in the same set, as shown in FIG. 2.

Both ends of each chain 18*a-d* are attached to respective securing portions 22 which are connected to the plate 10, in a practical embodiment via suitable adjusting bolts.

On the plate 10, in the area at the ends of the engagement portions 19*a,b*, rotatable support units 24*a-d* are placed in the subsequently mentioned first turning wheel. The first turning wheels 24*a-d* are rotatable in the torque tong's rotational plane and are placed in such a manner that in pairs they keep their respective chain 18*a-d* in engagement with and/or abutment against the torque tong 16. The position of the first turning wheels in relation to the torque tong therefore defines the above-mentioned engagement portion 19*a-c* for the respective chain against the corresponding segment 16*a,b*.

As illustrated in the figures, each chain 18*a-d* runs round respective pairs of first turning wheels 24*a-d* and on to two second turning wheels 28*a-d* which are rotatably mounted in pairs on a movement element 26*a,b*, before reaching their respective securing portions 22.

As illustrated, for example, in FIGS. 2 and 3, the first turning wheels 24*a-d* mounted on the plate 10 and the second turning wheels 28*a-d* on the movement element 26*a,b* cause the chain's direction to be reversed twice between the end of each engagement portion 19*a-d* and the respective securing portion 22. As an example, FIGS. 2 and 3 illustrate how the chain with reference numeral 18*a* runs round a pair of first turning wheels with reference numeral 24*a* and on round a pair of second turning wheels with reference numeral 28*a*. For obvious reasons, all the turning wheel pairs, for example for the chains 18*b* and 18*d*, are not shown in the figures.

Since each of the chains is securely fixed at each end and arranged in this manner over the turning wheels, a 1:2 gear ratio is achieved over the second turning wheels 28*a-d* on the movement elements 26*a,b*. This means that the movement elements 26*a,b* have to move half the distance that a point on the segment 16*a,b* has to move. The result is that the necessary stroke length for the movement element is halved, leading to a reduction in the space required for the torque tong 16 and the tool unit 4.

Figure 6:
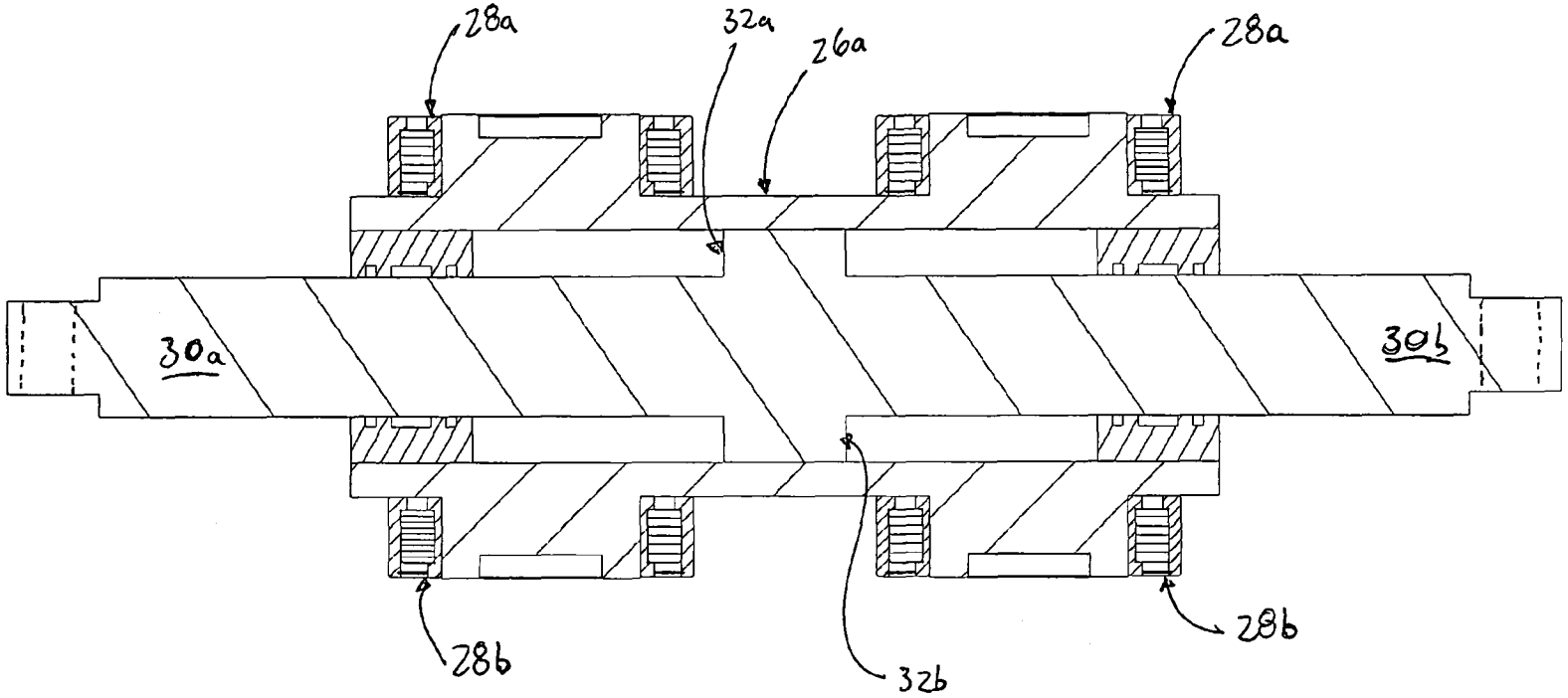
FIG. 6 is a sectional drawing of an embodiment of a movement element, viewed from one side.

In the illustrated embodiment the movement element 26*a,b* comprises a cylinder housing 26*a,b* which is slidably mounted on a through-going cylinder rod with first 30*a* and second 30*b* ends. In the illustrated embodiment the cylinder housings are non-differential (linear) cylinders for hydraulic operation, of a known type. As a person skilled in the art will know, and with reference to FIG. 6, a cylinder of this kind comprises a through-going rod with respective ends 30*a,b* and with a fixed piston with piston surfaces 32*a,b* inside the cylinder housing. It is well known that such a configuration with equal piston area on both sides of the piston gives equal power, no matter on which side of the piston pressure is applied.

In the described embodiment the cylinder rod's first 30*a* and second 30*b* ends are attached to respective securing portions 31, which in turn are attached to the plate 10. Hydraulic couplings are not shown, since these are well known to a person skilled in the art, but it is therefore apparent that when a hydraulic pressure is applied on one 32*a* or the other 32*b* side of the piston inside the cylinder housing 26*a,b*, the actual respective cylinder housing 26*a,b* will move on the fixed rod.

As mentioned above, in the illustrated embodiment two chains are arranged against each segment. The fact that the chains are located in two planes, above and below the rotary cylinder's housing 26*a,b* and rod 30*a,d* means that these components will not be exposed to any bending moment.

Each chain 18*a-d* is advantageously connected to the torque tong 16 via respective attachment points 20, thereby ensuring a fixed connection between chain and torque tong. As shown in FIG. 3, the attachment points 20 are located substantially in the middle of each circular arc-shaped segment 16*a,b* when the torque tong 16 is in a neutral or central position. As FIGS. 4 and 5 illustrate, the rotation of the torque tong 16 will cause the attachment points' 20 position relative to the respective chain's engagement portion to be moved.

FIG. 3 also illustrates the practical solution that each chain 18*a-d* may comprise two chain parts which are interconnected at the attachment point 20, thereby functionally creating one chain.

FIGS. 1-3 illustrate the torque tong and the associated rotary devices in a central position, as they will normally appear when inserting and withdrawing the pipe in the torque tong's opening 16'. Both the cylinder housings 26*a,b* are in a central position.

Figure 4:
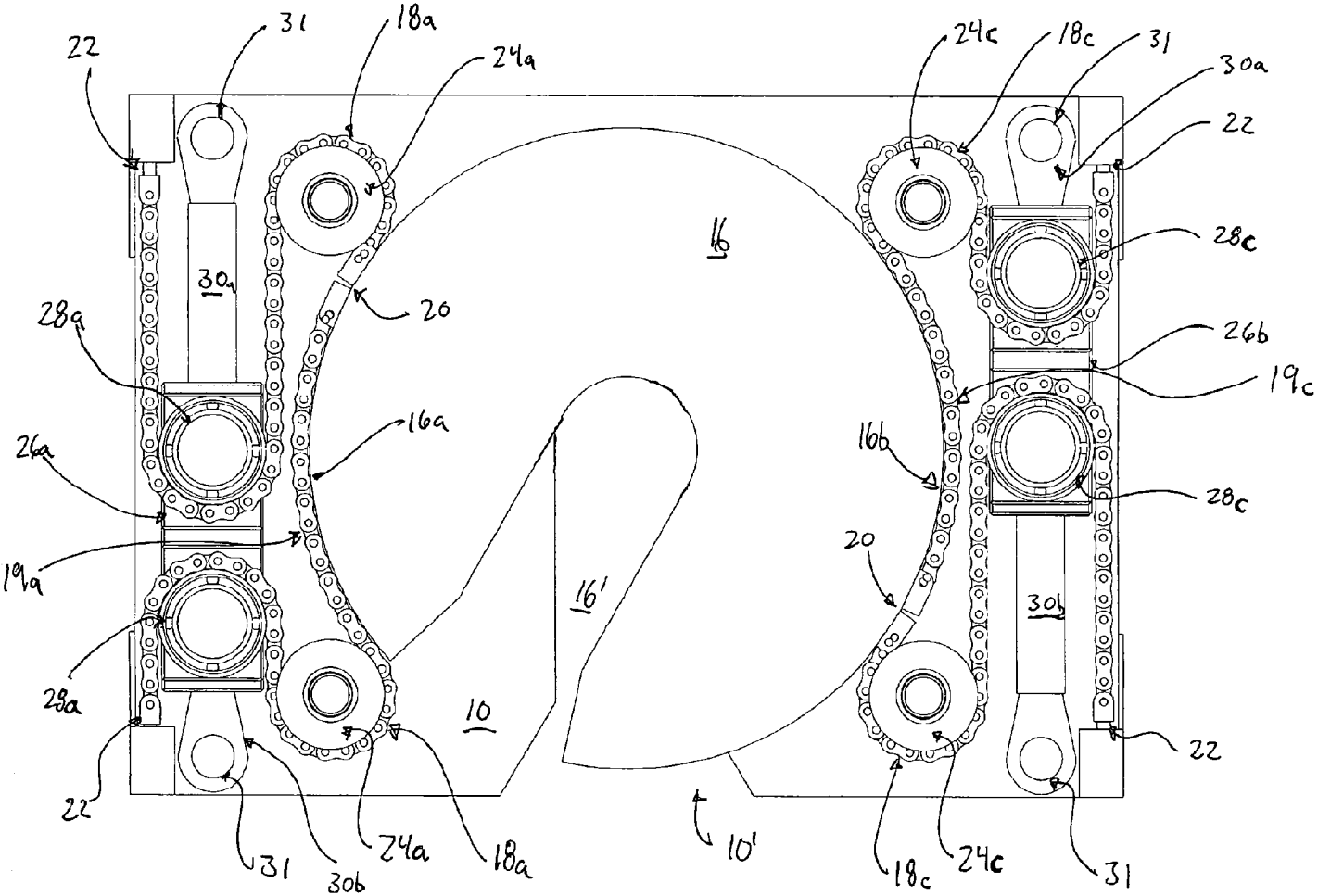
FIG. 4 shows the torque tong illustrated in FIG. 3, but where the torque tong is in a first deflection position.
Figure 5:
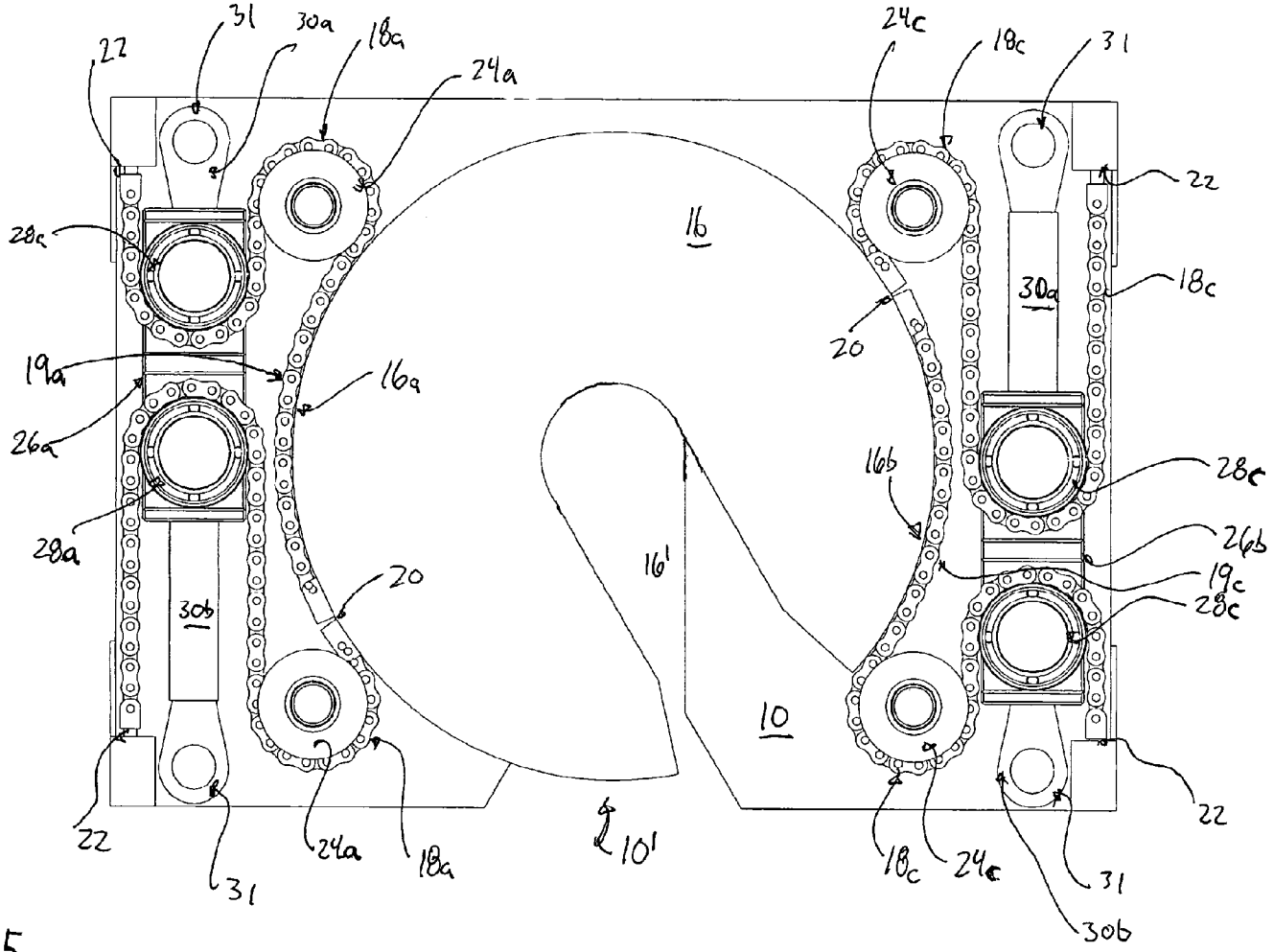
FIG. 5 shows the torque tong illustrated in FIG. 3, but where the torque tong is in a second deflection position.

FIG. 4 illustrates the torque tong in a maximum deflection position in one direction from the central position (to the left in this case). The first cylinder housing 26*a* is set in one extreme position and the second cylinder housing 26*b* is set in an extreme position opposite the first cylinder housing's 26*a* extreme position. This movement of the two cylinder housings, from the central position in FIG. 3 to the deflection position in FIG. 4, therefore causes a rotation of the torque tong from a central position to a first deflection position.

In a similar manner FIG. 5 shows the torque tong in a maximum second deflection position in the other direction from the central position (to the right in this case), i.e. opposite that illustrated in FIG. 4. Here the cylinder housings 26*a,b* are moved to opposite extreme positions compared to that illustrated in FIG. 4.

A skilled person will appreciate that the torque tong 16 does not necessarily have to be circular as illustrated in the attached figures, but must at any time (when the torque tong is rotated) at least comprise diametrically opposite circular arc-shaped portions 16*a,b* for engagement with respective chains 18*a-d*, thereby ensuring that during rotation the torque tong is always guided towards its centre.

In FIGS. 4 and 5 it can be seen that the diametrically opposite circular arc-shaped segments 16*a,b* and the respective adjacent engagement portions 19*a,c* (19*b,d* are hidden) have rotated in a corresponding manner to the torque tong's rotation, but in such a way that both the segments 16*a,b* and the engagement portions 19*a,c* are delimited by the respective sets of turning wheels 24*a,b*. The principle is that the distance between the turning wheels in each pair is crucial for how much the tong can rotate. In the illustrated embodiment the torque tong can rotate altogether 60°, i.e. from the first deflection position illustrated in FIG. 4 to the second deflection position illustrated in FIG. 5.

It has been shown to be advantageous to use lifting chains 18*a-d* secured in the torque tong at the securing point 20. In the illustrated embodiment the torque tong's circular arc-shaped segments are in the form of abutment surfaces for the chains. In another embodiment, however, the chains may be replaced by flexible bands or belts in abutment against the abutment surfaces.

Even though the described embodiment is illustrated with two chains 18*a-d* on each side of the torque tong since this provides a compact solution, in principle it is sufficient to have one belt or chain on each side.

Another solution may be to use one or more roller chains in engagement with suitable teeth along each of the segments 16*a,b*.

The movement element 26*a,b* is illustrated here as a cylinder housing 26*a,b* slidably mounted on a cylinder rod with respective ends 30*a,b* attached to the plate 10, where the cylinder housing is moved on the cylinder rod by means of hydraulic pressure. The movement element, however, should not be restricted to this embodiment, as long as it describes a movement as described above in order to move the second turning wheels. In principle, therefore, the cylinder rod may be replaced by a threaded, rotatable stem, rotatably attached to the securing portions 31 and which by means of rotation and interaction with threads in the movement element will be able to move it forwards and backwards in a similar manner to that described above.

Figure 7:
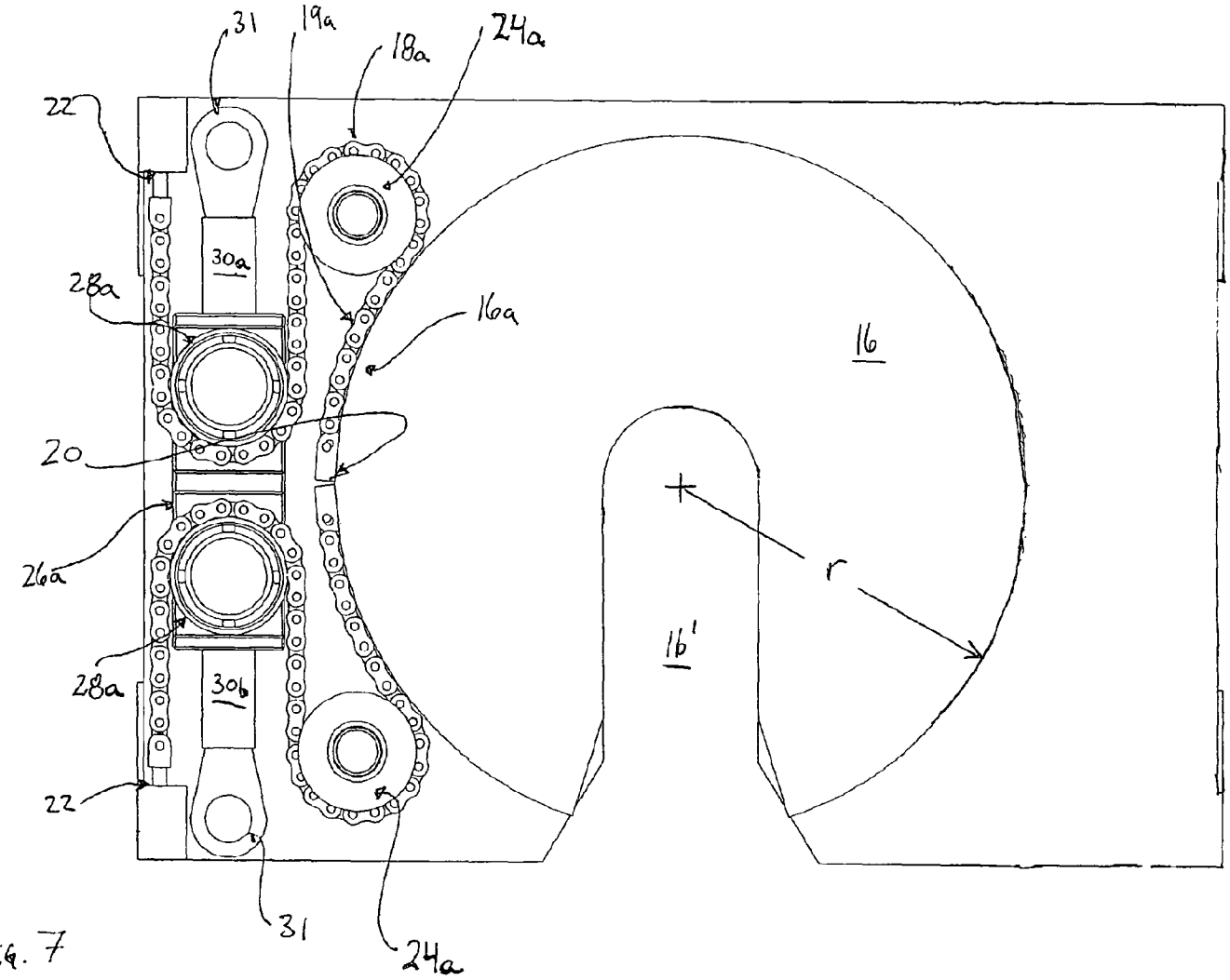
FIG. 7 illustrates a second embodiment of the torque tong as illustrated in FIG. 3.

The embodiment illustrated in FIG. 7 corresponds to the embodiment illustrated in the other figures, but in this case the torque tong 16 is depicted with one circular arc-shaped segment 16*a* (and not two) against each of which one or more chains 18*a,b* are secured. The individual chain is operatively connected to a drive arrangement, illustrated here comprising first turning wheels 24*a,b* and second turning wheels 28*a,b* on the movement element 26*a,b*. Chains and the drive arrangement illustrated here have a similar construction and mode of operation to that shown in the other figures, but in this case rotation of the torque tong is provided by abutment of one or more chains 18*a*, 18*b* against one circular arc-shaped segment, and not two. The circular arc-shaped segment 16*a* may by positioned in any way whatever around the torque tong's external circumferential side. For example, the circular arc-shaped segment 16*a* may be positioned on the opposite circumferential side to that illustrated in FIG. 7, i.e. on the right side instead of the left side or on the side of the torque tong which is diametrically opposite the opening 16'.

The invention claimed is:

1. A device for rotation of a torque tong, comprising:

at least one circular arc-shaped segment;

gripping devices for holding a pipe substantially perpendicularly on a radial plane of the torque tong; and at least one elongated flexible drive element in abutment with the at least one circular arc-shaped segment and operatively connected to first support units and devices for movement of the at least one drive element so that the torque tong is rotated in the radial plane, wherein said devices for movement comprise:

a pair of second support units rotatably mounted on a respective movement element arranged for rectilinear movement in the radial plane of the torque tong, and wherein a portion of the drive element located between one of the first support units and a respective securing portion is mounted on the respective second support unit, and wherein the movement element includes a cylinder housing which is slidably mounted on a stem and at least a first or second end is attached to a fastening and where on the stem in an internal chamber of the cylinder housing there is provided a cylinder piston of a known type with oppositely directed piston areas, so that the cylinder housing is movable along the stem when a hydraulic fluid is supplied to the chamber on one side or an other side of the piston.

2. The device according to claim 1, wherein the torque tong has at least two circular arc-shaped segments which are diametrically opposite and at least one elongated flexible drive element is assigned to each segment and in abutment thereto.

3. The device according to claim 2, wherein an individual drive element is attached at first and second ends thereof to respective securing portions and further comprises an engagement portion which is in engagement with and/or abutment against a segment.

4. The device according to claim 2, wherein the torque tong includes a substantially circular body in the said radial plane, and an opening for insertion of a pipe which is to be gripped by the gripping devices.

5. The device according to claims 2, wherein the individual drive element is attached to its respective segment at an attachment point on the torque tong, where the attachment point is located substantially halfway between the ends of the segment when the torque tong is in a central position.

6. The device according to claim 1, wherein an individual drive element is attached at first and second ends thereof to respective securing portions and further comprises an engagement portion which is in engagement with and/or abutment against said arc-shaped segment.

7. The device according to claim 6, wherein the support units for the individual drive element comprise a pair of first support units rotatably mounted adjacent to each end of the engagement portion.

8. The device according to claim 7, wherein the torque tong includes a substantially circular body in the said radial plane, and an opening for insertion of a pipe which is to be gripped by the gripping devices.

9. The device according to claim 6, wherein the securing portions for the individual drive element are attached to the plate.

10. The device according to claim 6, wherein the torque tong includes a substantially circular body in the said radial plane, and an opening for insertion of a pipe which is to be gripped by the gripping devices.

11. The device according to claim 1, wherein the torque tong includes a substantially circular body in the said radial plane, and an opening for insertion of a pipe which is to be gripped by the gripping devices.

12. The device according to claim 11, wherein the fastenings for the cylinder stem are attached to the plate.

13. The device according to claim 1, wherein the individual drive element is attached to its respective segment at an attachment point on the torque tong, where the attachment point is located substantially halfway between the ends of the segment when the torque tong is in a central position.

14. The device according to claim 1, wherein the individual drive element comprises a lifting chain which is fixed in the tong at an attachment point.

15. The device according to claim 1, wherein the torque tong is supported in the axial direction by a plate, via friction-reducing means.

16. The device according to claim 1, wherein the first support units are rotatably attached to the plate.

17. The device according to claim 1, wherein a first set of drive elements is assigned to a first segment and a second set of drive elements is assigned to a second segment, where the drive elements in each set are placed one above the other and are movable in the radial plane of the torque tong.

18. A method for rotation of a torque tong, the torque tong comprising:

at least one circular arc-shaped segment;

gripping devices for holding a pipe substantially perpendicularly on a radial plane of the torque tong; and at least one elongated flexible drive element in abutment with the at least one circular arc-shaped segment and operatively connected to first support units and devices for movement of the at least one drive element so that the torque tong is rotated in the radial plane, wherein said devices for movement comprise:

a pair of second support units rotatable mounted on a first movement element arranged for rectilinear movement in the radial plane of the torque tong, and wherein a portion of the drive element located between one of the first support units and a respective securing portion is mounted on the respective second support unit, wherein the movement element includes a cylinder housing which is slidably mounted on a stem and at least a first or second end is attached to a fastening and where on the stem in an internal chamber of the cylinder housing there is provided a cylinder piston of a known type with oppositely directed piston areas, so that the cylinder housing is movable along the stem when a hydraulic fluid is supplied to the chamber on one side or an other side of the piston, said method comprising the steps of:

implementing a rectilinear movement of a said first movement element; and simultaneously implementing a rectilinear movement of a second movement element in the opposite direction to and substantially parallel to the movement of the first movement element.

* * * * *